United States Patent [19]

Saraceni

[11] Patent Number: 4,847,739

[45] Date of Patent: Jul. 11, 1989

[54] DECORATIVE LIGHT WITH ROTATING REFLECTIVE DISC

[76] Inventor: Remo Saraceni, 400 Green St., Philadelphia, Pa. 19123 .

[21] Appl. No.: 190,254

[22] Filed: May 4, 1988

[51] Int. Cl.[4] ..... F21S 1/02

[52] U.S. Cl. ..... 362/232; 362/301; 362/303; 362/811

[58] Field of Search ..... 362/211, 212, 213, 214, 362/215, 232, 233, 300, 301, 303, 811

[56] References Cited

U.S. PATENT DOCUMENTS

| | | | |
|---|---|---|---|
| 3,242,330 | 3/1966 | Schoffer | 362/811 |
| 3,700,880 | 10/1972 | Smith | 362/811 |
| 3,742,206 | 6/1973 | Summa | 362/871 |

*Primary Examiner*—Ira S. Lazarus

*Assistant Examiner*—Sue Hagarman

*Attorney, Agent, or Firm*—Steele, Gould & Fried

[57] ABSTRACT

A decorative light with rotating reflecting disc is disclosed which includes a mounting base and a translucent dome secured upon the base. A plurality of sockets with lamps are mounted in the base beneath the dome and each socket can contain a lamp of different color. A motor is concentrically secured in the base to rotate a circular reflector below the lamps to reflect light rays from the lamps upwardly against the undersurface of the translucent dome. The surface of the circular reflector is covered with a crinkled or otherwise bent "Milar" sheet to form a great multitude of small, angularly offset reflecting surfaces so that a unique, colored, reflected, light pattern is projected upon the underside of the dome by the rotating reflector.

5 Claims, 1 Drawing Sheet

DECORATIVE LIGHT WITH ROTATING REFLECTIVE DISC

BACKGROUND OF THE INVENTION

1. Field of the Invention

This invention relates generally to the field of decorative lighting, and more particularly, is directed to an illuminated, decorative, aesthetically pleasing fixture suitable for hanging display upon the wall of a residential or commercial establishment.

2. Discussion of the Prior Art

Decorative lighting fixtures are well known in the art and prior workers have developed numerous types and varieties of illuminated and other fixtures suitable for hanging upon a wall or for being secured to a ceiling construction.

The prior art materials are replete with various designs and configurations of decorative fixtures and numerous prior designs have incorporated non-rotative shades or covers having rotatable elements secured below the cover. It is also known to fabricate such decorative fixtures with translucent covers or reflectors to allow illumination from electric lamps to shine through the plastic materials comprising the cover. Translucent cover materials such as glass, acrylic plastic, and other suitable plastic materials have been used by prior workers in the art and have generally satisfactorily served the purpose of permitting illumination from interior positioned lamps to shine or reflect through the enclosing cover.

Despite all of the volume of prior art in this particular field, so far as is known to the present applicant, no one has heretofore developed a decorative light with a translucent plastic cover having lamps mounted therebeneath in combination with a rotating disc having a non-planar, rotating surface to provide a novel, varying, reflective pattern upon the interior surface of the enclosing dome or cover.

SUMMARY OF THE INVENTION

The present invention relates to decorative lighting in general, and more particularly, is directed to a decorative light with a rotating reflective disc wherein the disc rotates below the electric lamps and above a rotating reflector to reflect a varying light pattern upon the under surface of the enclosing dome or cover.

The present invention includes a circular base having a peripheral flange for mounting a plurality of conventional sockets to receive electric lamps therewithin in conventional manner. A motor is centrally mounted in the base to rotate its shaft below the sockets and lamps. A reflective disc is mounted for rotation below the lamps and is constantly rotated when the motor is energized.

The reflective disc of the present invention is preferably covered with a non-planar reflective material, such as crushed MILAR reflective sheet plastic material, to provide a crumpled, non-planar reflector having a great multitude of variously angularly offset reflecting surfaces of non-uniform orientation.

A translucent cover or dome mounts upon the flange of the base in a secure manner in position to receive the varying reflections from the reflector disc as the disc is rotated below the lamps. Preferably, the dome is fabricated of translucent acrylic plastic of milky white appearance to provide the finished portion of the decorative light. The acrylic plastic dome is fabricated to be non-transparent and provides a finished, pleasing appearance when the decorative light is not in operation. When in operation with the lamps lit and with the reflector disc in rotation, the light reflective pattern generated by the multitudinous reflective surfaces of the crushed MILAR reflective sheet plastic material on the reflective disc provides a rotating, continuously varying, reflective pattern upon the underside of the dome-shaped cover. This reflective pattern is continuously varying an appears through the translucent acrylic plastic dome as a pleasing, quieting, continuously varying shadow pattern.

It is therefore an object of the present invention to provide an improved decorative light with rotating reflective disc of the type set forth.

It is another object of the present invention to provide a novel decorative light with rotating reflective disc comprising a translucent dome, a plurality of lamps mounted below the dome and a non-planar, reflecting disc rotatively mounted below the lamps to provide a continuously varying pattern upon the underside of the translucent dome.

It is another object of the present invention to provide a novel decorative light with rotating reflective disc comprising generally a fixed base, a plurality of lamps mounted upon the base in circularly spaced locations, a reflective disc rotatively mounted below the lamps to reflect the rays of the lamps, the disc having a crinkled MILAR reflective sheet plastic material reflective surface, a motor mounted upon the base to rotate the reflective disc and an acrylic plastic dome covering the base, the underside of the dome receiving the varying reflected light pattern from the reflective disc to display an exterior, rotating, continuously varying reflective pattern.

It is another object of the present invention to provide a novel decorative light with rotating reflective disc that is inexpensive in manufacture, trouble free in operation and aesthetically pleasing when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figures 1, 2:
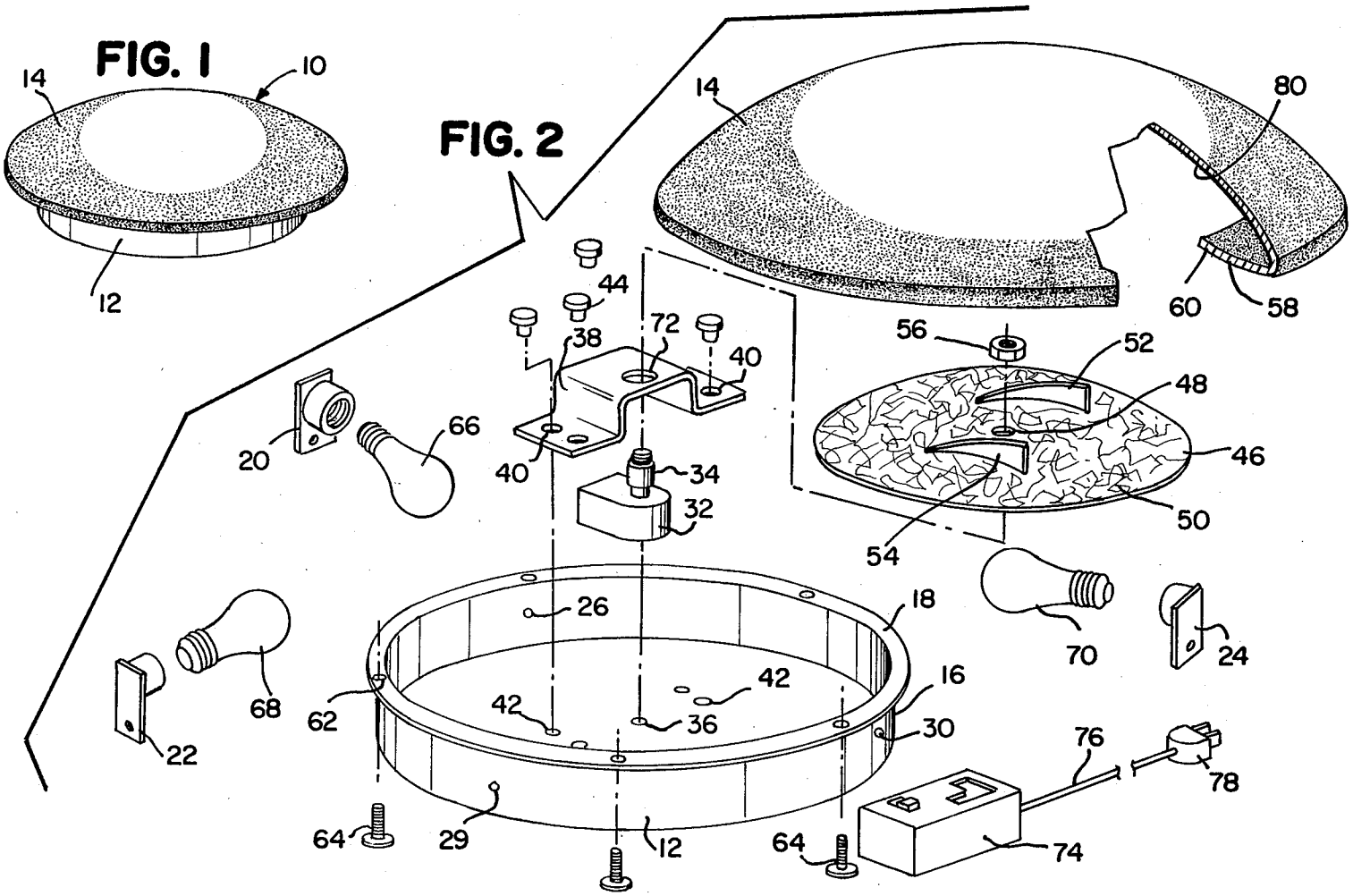
FIG. 1 is a perspective view of the decorative light with rotating reflective disc constructed in accordance with the teachings of the present invention.
FIG. 2 is an enlarged, exploded, perspective view of the decorative light with rotating reflective disc of FIG. 1.

Although specific terms are used in the following description for the sake of clarity, these terms are intended to refer only to the particular structure of the invention selected for illustration in the drawings, and are not intended to define or limit the scope of the invention.

Referring now to the drawings, the decorative light 10 of the present invention comprises generally a steel or other sturdy material base 12. The base is illustrated in circular configuration, but the invention is not limited to any particular shape. It will be appreciated that the exact shape of the base 12 and the translucent dome 14 need not be limited to that illustrated, but rather, can be of any desired configuration to provide an aesthetically pleasing final appearance for the decorative reflective light in accordance with the ingenuity and capability of the designer.

The base 12 includes a circular, peripheral sidewall 16 which terminates upwardly in a circular, radially outwardly extending peripheral mounting flange 18. The flange 18 is drilled or otherwise machined to provide a plurality of mounting openings 62 for securing the translucent dome 14 to the base 12 in well known manner by employing suitable fasteners.

As best seen in FIG. 2, the base sidewall 16 is drilled or otherwise treated to provide a plurality of lamp mounting openings 26, 28, 30. While three socket mounting openings and three lamp sockets are illustrated, more or fewer lamps may be included and still fall within the intent and scope of this invention. Conventional lamp sockets 20, 22, 24 include mounting opening and are conventionally secured within the base 12 at the mounting openings 26, 28, 30 by using conventional fasteners in the usual way. Lamps or bulbs 66, 68, 70 of desired wattage are operatively secured within the sockets 20, 22, 24 which are wired in conventional manner to energize the lamps when the decorative reflective light 10 is in use.

A motor mounting opening or openings 36 are provided in the center of the base 12 to secure a small electric motor 32 therewithin in a manner to position the motor shaft 34 concentrically within the area defined by the base sidewall 16. A reflector bracket 38 mounts over the motor 32 and receives the motor shaft 34 through the opening 72 provided therein and serves as a support for the circular reflector 46. A plurality of cooperating mounting openings 40, 42 are respectively provided in the bracket 38 and in the base 12 to facilitate securing the bracket 38 to the base 12 by employing a plurality of conventional mounting screws or fasteners 44. A circular, generally planar reflector 46 is provided with a shaft receiving opening 48 and is mounted for rotation upon the top surface of the bracket 48. A suitable mounting nut 56 secures the circular reflector 46 to the motor shaft 34 in a manner to rotate the circular reflector 46 at all times when the motor 32 is energized.

The circular reflector 46 is provided with a unique reflecting surface 50 which is non-planar in configuration and which is particularly formed to provide a multitude of variously angularly oriented small reflecting surfaces. At the present time, the reflecting surface 50 is formed by providing a layer of MILAR reflective sheet plastic material which is crushed and bent prior to affixing to the reflector 46. The crushed and bent MILAR reflective sheet plastic material layer naturally forms a multitude of angularly oriented reflecting surfaces which can be made more or less numerous by varying the degree of crushing prior to affixing to the reflector. The height of the bracket 38 is formed to be less than the mounting height of the lamp sockets 20, 22, 24 so that the circular reflector 46 will be positioned to be rotated beneath the lamps 66, 68, 70 whereby some of the light rays (not shown) from the lamps will be directed downwardly upon the reflecting surface 50 and then will be reflected in multitudinous angularly oriented rays upwardly, away from the circular reflector 46.

If desired, one or more baffles 52, 54 can be affixed directly upon the reflecting surface 50 in angular orientation to the general plane of the circular reflector 46. The exposed surfaces of the baffles 52, 54 are preferably similarly covered with crushed MILAR reflective sheet plastic material sheet to provide additional angularly oriented reflected light rays and to provide light baffles intermediate the various lamps 66, 68, 70 as the circular reflector 46 is rotated upon activation of the motor 32. In this manner, it is possible to use individual lamps 66, 68, 70 of different colors and these colors will be separated one from another as the circular reflector 46 is rotated by the light blocking action of the baffles 52, 54.

A suitable remote control switch 74 is wired in series with the sockets 20, 22, 24 to be conventionally activated by an exterior control (not shown) such as a remote sonic actuator, a remote proximity actuator or similar device of known construction. Alternately, the switch 74 could be manually operated to draw power through the electrical cord 76 in usual manner. The cord plug 78 should be connected to a conventional wall outlet in usual manner to activate the circuit when the switch 74 is switched to its "on" position, either remotely or manually. In the preferred embodiment, the electric motor 32 is also wired in series with the switch 74 and the sockets 20, 22, 24 whereby the motor will rotate the circular reflector 46 at all times when the lamps 66, 68, 70 are illuminated.

Still referring to FIG. 2, the dome or cover 14 is fabricated of translucent material, but not transparent material, such as suitable acrylic plastic of milky white color. Accordingly, any of the light rays that are angularly reflected by the reflecting surface 50 of the circular reflector 46 will be directed upon the underside of the dome 14 and, due to the translucent nature of the dome, the circular light patterns can be viewed from the exterior of the decorative reflective light 10. The translucent dome 14 terminates inwardly in an inwardly turned, peripheral flange 58 portion, which flange overfits the mounting flange 18 of the decorative reflective light base 12. The mounting flange 18 is provided with a plurality of mounting openings 62 whereby the translucent dome 14 can be readily secured to the base 12 by directing a plurality of mounting screws 64 through the openings 62 and into the material comprising the dome flange 58.

Preferably, the flange extends radially inwardly a sufficient distance to cover at least a portion of the lamps 66, 68, 70 to restrict a portion of the reflected light rays from impinging directly upon the dome-shaped undersurface 80 of the translucent dome 14. Preferably, the bottom surface of the reflector flange 58 is covered with a black coating 60 to prevent passage of reflected light rays therethrough. It has been found that the employment of the reflector flange 58 aids in the development of the aesthetically pleasing reflective pattern upon the undersurface 80 of the translucent dome 14. The annular black surface 60 enhances the color reflection from the various colored bulbs or lamps 66, 68, 70 and provides a better colored finish. Without the employment of the black undersurface, the reflected pattern would tend to lose color and produce a whitish revolving reflected pattern. Such a whitish, color washed pattern is not as aesthetically pleasing as the revolving color pattern produced when using the black undersurface.

Although the present invention has been described with reference to the particular embodiments herein set forth, it is understood that the present disclosure has been made only by way of example, and that numerous changes in the details of the construction may be resorted to without departing from the spirit and scope of the invention. Thus, the scope of the invention should not be limited by the foregoing specification, but rather, only by the scope of the claims appended hereto.

What is claimed is:

1. A decorative light comprising:

a hollow base, the base comprising sidewalls extending upwardly from the base;

a plurality of lamp sockets secured in the base sidewall in spaced locations;

a plurality of lamps respectively mounted in the lamp sockets, at least one of the plurality of lamps being of a color different from another lamp;

a motor secured to the base, said motor rotating a shaft;

a generally planar reflector secured to the motor shaft for rotatation when the motor is operative, the reflector being positioned below the lamps to receive light rays from the lamps, the reflector comprising a multitude of angularly offset reflecting surfaces, the reflecting surfaces receiving light rays from the lamps and reflecting the light rays away from the reflector at a multitude of angles;

a pair of spaced baffles extending away from the reflector and being positioned at right angles to the reflector, the motor shaft being positioned between the baffles, the baffles being so positioned upon the reflector as to separate the light rays of one lamp from the light rays of another lamp when the reflector is rotated;

a translucent cover secured to the base in overlying relationship to the reflector and to the lamps, the translucent cover having a non-transparent body, the said body being impinged by the multitude of angularly oriented reflected light rays; and an operating electrical circuit to simultaneously energized the lamp sockets and the motor.

2. The decorative light of claim 1 wherein the reflecting surfaces comprise a continuous sheet of MILAR sheet plastic reflecting material, the sheet being bent and crinkled to form the plurality of angularly offset reflecting surfaces.

3. The decorative light of claim 1 wherein each baffle comprises a reflecting surface and wherein the reflecting surfaces comprise MILAR sheet plastic material, the sheet being bent and crinkled to form a plurality of angularly offset reflecting surfaces.

4. The decorative light of claim 1, wherein the translucent cover comprises a bottom flange, the bottom of flange extending radially inwardly and is oriented in planar, spaced relationship to the generally planar reflector, portion of the bottom flange overlying a portion of the base whereby the translucent cover can be secured to the base by applying fasteners respectively through the base and the cover flange.

5. The decorative light of claim 4 wherein the cover bottom flange comprises a bottom surface and wherein the bottom surface is covered with light rejecting coating.

* * * * *